US009562358B2

(12) United States Patent
Lanphear

(10) Patent No.: US 9,562,358 B2
(45) Date of Patent: Feb. 7, 2017

(54) ADJUSTABLE STAIRCASE AND HEIGHT-ADJUSTABLE PLATFORM WITH ADJUSTABLE STAIRCASE

(71) Applicant: John Stephen Lanphear, Lawrence, MI (US)

(72) Inventor: John Stephen Lanphear, Lawrence, MI (US)

(73) Assignee: John Stephen Lanphear, Lawrence, MI (US)

( * ) Notice: Subject to any disclaimer, the term of this patent is extended or adjusted under 35 U.S.C. 154(b) by 0 days.

(21) Appl. No.: 14/605,655

(22) Filed: Jan. 26, 2015

(65) Prior Publication Data

US 2015/0211234 A1 Jul. 30, 2015

Related U.S. Application Data

(60) Provisional application No. 61/931,617, filed on Jan. 26, 2014.

(51) Int. Cl.

| | |
|---|---|
| ***E04F 11/00*** | (2006.01) |
| ***E04F 19/00*** | (2006.01) |
| ***E04F 11/06*** | (2006.01) |
| ***E04G 1/18*** | (2006.01) |
| ***E04G 1/28*** | (2006.01) |
| ***E04G 5/10*** | (2006.01) |
| ***E04G 5/14*** | (2006.01) |
| ***E04G 27/00*** | (2006.01) |
| ***E06C 1/39*** | (2006.01) |
| *E04G 13/06* | (2006.01) |
| *E04F 11/025* | (2006.01) |
| *E04F 11/18* | (2006.01) |

(52) U.S. Cl.

CPC ..... *E04F 11/06* (2013.01); *E04G 1/18* (2013.01); *E04G 1/28* (2013.01); *E04G 5/10* (2013.01); *E04G 5/14* (2013.01); *E04G 27/00* (2013.01); *E06C 1/39* (2013.01); *E04F 11/0255* (2013.01); *E04F 11/1834* (2013.01); *E04G 13/06* (2013.01); *E04G 13/062* (2013.01)

(58) Field of Classification Search

CPC .... E04F 11/0255; E04F 11/1834; E04F 11/06; E04G 13/06; E04G 13/062; E04G 1/28; E04G 1/18; E04G 5/08; E04G 5/10; E04G 27/00

USPC ..... 52/182, 183; 182/1, 228.1; 14/71.1

See application file for complete search history.

(56) References Cited

U.S. PATENT DOCUMENTS

| | | | | |
|---|---|---|---|---|
| 298,212 | A | 5/1884 | Knight | |
| 300,395 | A | 6/1884 | Peterson | |
| 2,245,825 | A * | 6/1941 | Ross | A47C 1/12 108/1 |
| 3,470,664 | A | 10/1969 | Whitehead | |

(Continued)

FOREIGN PATENT DOCUMENTS

| | | |
|---|---|---|
| JP | 2001350404 | 12/2001 |

*Primary Examiner* — Chi Q Nguyen

(74) *Attorney, Agent, or Firm* — Diederiks & Whitelaw, PLC

(57) ABSTRACT

An adjustable staircase includes an upper stair, a lower stair, a first bar and a second bar. The vertical distance between the upper stair and the lower stair is adjustable. Also, each bar is coupled to each of the upper and lower stairs, and the first bar is configured to function as a guard. As a result, the first bar blocks a pinch point between the first and second bars.

14 Claims, 7 Drawing Sheets

(56) References Cited

U.S. PATENT DOCUMENTS

| | | | | | |
|---|---|---|---|---|---|
| 3,626,438 | A | | 12/1971 | Cornell | |
| 3,731,761 | A | | 5/1973 | Glenn | |
| 3,885,365 | A | | 5/1975 | Cox | |
| 3,962,838 | A | | 6/1976 | Cox | |
| 4,168,764 | A | | 9/1979 | Walters | |
| 4,406,347 | A | * | 9/1983 | Stathopoulos | E04F 11/0255 182/1 |
| 4,720,116 | A | * | 1/1988 | Williams | B60R 3/02 182/127 |
| 4,959,935 | A | * | 10/1990 | Stob | E01D 15/24 182/156 |
| 5,137,114 | A | * | 8/1992 | Yde | E04F 11/002 14/71.1 |
| 5,154,569 | A | * | 10/1992 | Eryou | A61G 3/063 14/71.3 |
| 5,553,421 | A | | 9/1996 | Stratford | |
| 5,636,483 | A | * | 6/1997 | Wille | E04F 11/0255 182/228.1 |
| 6,354,403 | B1 | * | 3/2002 | Truckner | E04F 11/0255 182/1 |
| 6,397,529 | B1 | * | 6/2002 | Grenier | E04F 11/0255 52/182 |
| 6,810,995 | B2 | * | 11/2004 | Warford | E04F 11/025 182/113 |
| 7,383,600 | B2 | | 6/2008 | Carrigan | |
| 7,866,443 | B2 | | 1/2011 | Truckner et al. | |
| 9,091,083 | B1 | * | 7/2015 | Goudreau | E04F 11/066 |

* cited by examiner

ADJUSTABLE STAIRCASE AND HEIGHT-ADJUSTABLE PLATFORM WITH ADJUSTABLE STAIRCASE

CROSS REFERENCE TO RELATED APPLICATIONS

This application claims the benefit of U.S. Provisional Patent Application Ser. No. 61/931,617, which was filed on Jan. 26, 2014 and titled "Self Adjusting Staircase". The entire content of this application is incorporated by reference.

BACKGROUND OF THE INVENTION

The present invention pertains to adjustable staircases and, more particularly, to eliminating pinch points from such staircases.

By making a staircase adjustable, a single staircase can span gaps of different sizes. This feature is particularly beneficial when the staircase is used at different locations or when the staircase is coupled to a height-adjustable platform, for example. Unfortunately, the structure that provides this adjustability also introduces pinch points, which can injure a user of the staircase. For example, U.S. Pat. No. 298,212 discloses a gangway that includes side bars b and b'. As illustrated in FIGS. 5-7, the gap between side bars b and b' varies with the relative heights of end platforms a. As a result, anything located between side bars b and b' during adjustment of the gangway is likely to be damaged. Therefore, there is a need in the art for an adjustable staircase that eliminates such pinch points.

SUMMARY OF THE INVENTION

The present invention is directed to an adjustable staircase that includes an upper stair, a lower stair, a first bar and a second bar. The vertical distance between the upper stair and the lower stair is adjustable. Also, each bar is coupled to each of the upper and lower stairs, and the first bar is configured to function as a first guard. As a result, the first bar blocks a pinch point between the first and second bars.

Each of the first and second bars is located on the right side of the staircase. When viewed from the right side of the staircase, the second bar is not visible and the first bar extends across at least a portion of the second bar. The staircase further includes a second guard and a third guard, the third guard being coupled to or formed integrally with the upper stair. The third guard is also located on the right side of the staircase. When viewed from the right side of the staircase, the third guard extends across at least a portion of the second bar such that the pinch point is eliminated.

The first bar is coupled to a front portion of each of the upper and lower stairs, and the second bar is coupled to a rear portion of each of the upper and lower stairs. The second bar is located to the inside of the first bar. Specifically, the second guard is located to the outside of the first bar, the first bar is located to the outside of the third guard and the third guard is located to the outside of the second bar.

In one embodiment, the staircase includes a height-adjusting mechanism configured to adjust the vertical distance between the upper stair and the lower stair. In another embodiment, the staircase is part of a height-adjustable platform. In yet another embodiment, the second guard has a groove configured to support the first bar. Preferably, the groove is in-turned and U-shaped.

Additional objects, features and advantages of the present invention will become more readily apparent from the following detail description of preferred embodiments when taken in conjunction with the drawings wherein like reference numerals refer to corresponding parts in the several views.

DETAILED DESCRIPTION OF THE PREFERRED EMBODIMENTS

Detailed embodiments of the present invention are disclosed herein. However, it is to be understood that the disclosed embodiments are merely exemplary of the invention that may be embodied in various and alternative forms. The figures are not necessarily to scale, and some features may be exaggerated or minimized to show details of particular components. Therefore, specific structural and functional details disclosed herein are not to be interpreted as limiting, but merely as a representative basis for teaching one skilled in the art to variously employ the present invention.

In the art and as used in connection with the present invention, a pinch point is any point in between two or more relatively moving parts where a portion of a user's body or other object may become caught, thus leading to injury or damage. Also, when referring to the left or right side of a staircase constructed in accordance with the present invention, the relevant perspective is that of a person facing the staircase such that walking forward will result in the person ascending the staircase. While the following description focuses on the right side of a staircase, it should be noted that the left side of staircase includes corresponding structure and, therefore, functions in an analogous manner.

Figure 1A:
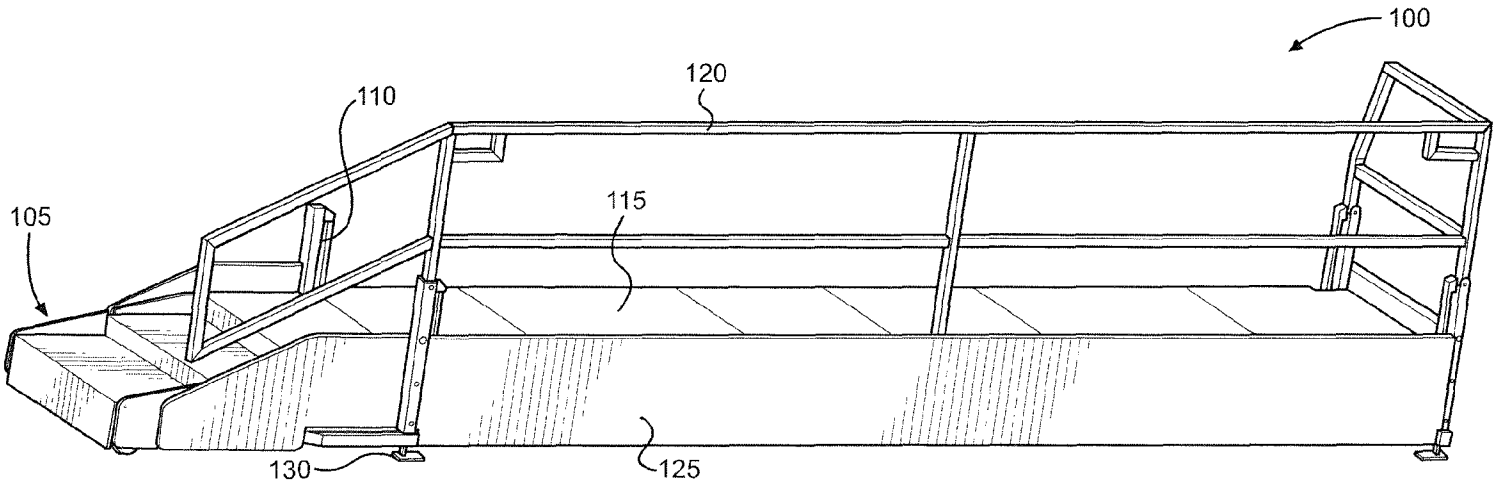
FIG. 1A is a perspective view of a height-adjustable platform, constructed in accordance with the present invention, with the platform located at a first height.
Figure 1B:
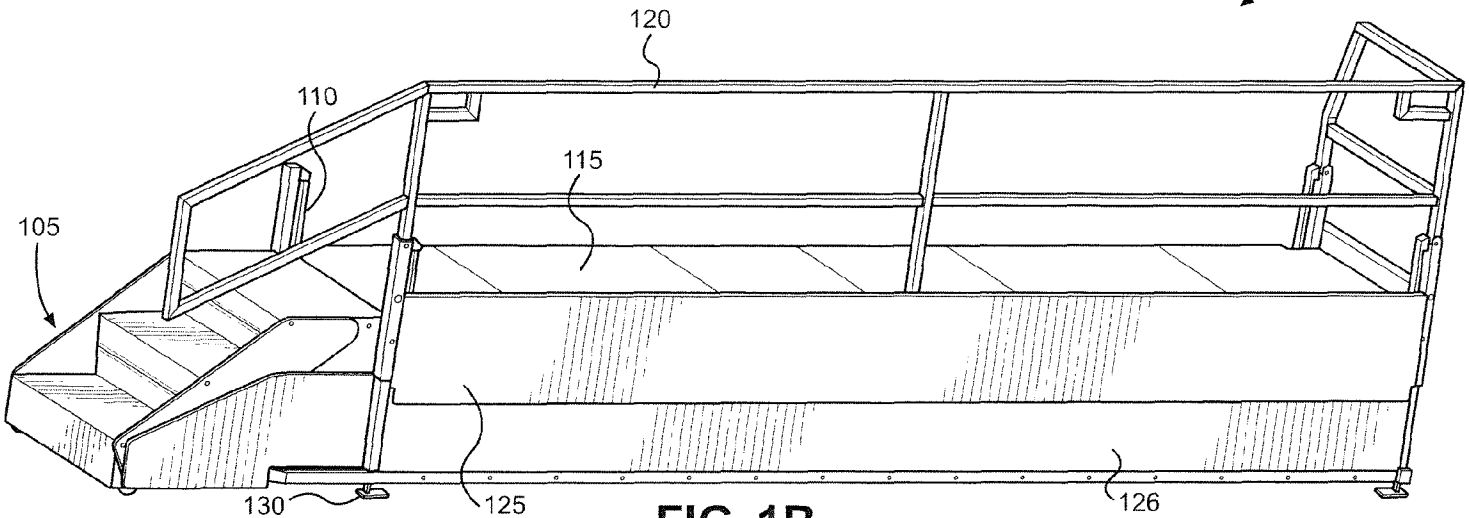
FIG. 1B is a perspective view of the platform at a second height.

With initial reference to FIGS. 1A and 1B, there is illustrated a height-adjustable platform 100 constructed in accordance with the present invention. Platform 100 includes an adjustable staircase 105, height-adjusting mechanisms (one of which is labeled 110), a support surface 115, a railing 120 and platform guards 125, 126. As the height of platform 100 is adjusted through the use of the height-adjusting mechanisms, staircase 105 automatically adjusts its height and the spacing of its stairs to match, as will be described below. The height-adjusting mechanisms preferably use screw drives, although other types of linear actuators can also be used (e.g., hydraulic, pneumatic). While FIGS. 1A and 1B show platform 100 at two different heights, platform 100 is selectively positionable at any number of different heights, as desired by a user. Support surface 115 provides an area for a user of platform 100 to stand while working on an adjacent assembly line or piece of machinery (not shown), and railing 120 prevents the user from accidentally falling off platform 100 in the opposite direction. Platform guards 125, 126 eliminate pinch points to protect the user during adjustment of platform 100. Staircase 105, support surface 115, railing 120 and platform guard 125 are interconnected so that the height adjusting mechanisms cause these structures to be simultaneously shifted relative to a surface on which platform 100 is supported. Optionally, platform 100 also includes feet or casters (one of which is labeled 130) for supporting platform 100 on the surface.

Although staircase 105 is described in connection with platform 100, an adjustable staircase, in accordance with the invention, can be used without such a platform (i.e., the staircase can be used independently). For example, an adjustable staircase can be used at a construction site to span the vertical distance between two surfaces prior to a fixed staircase being installed.

Figure 2A:
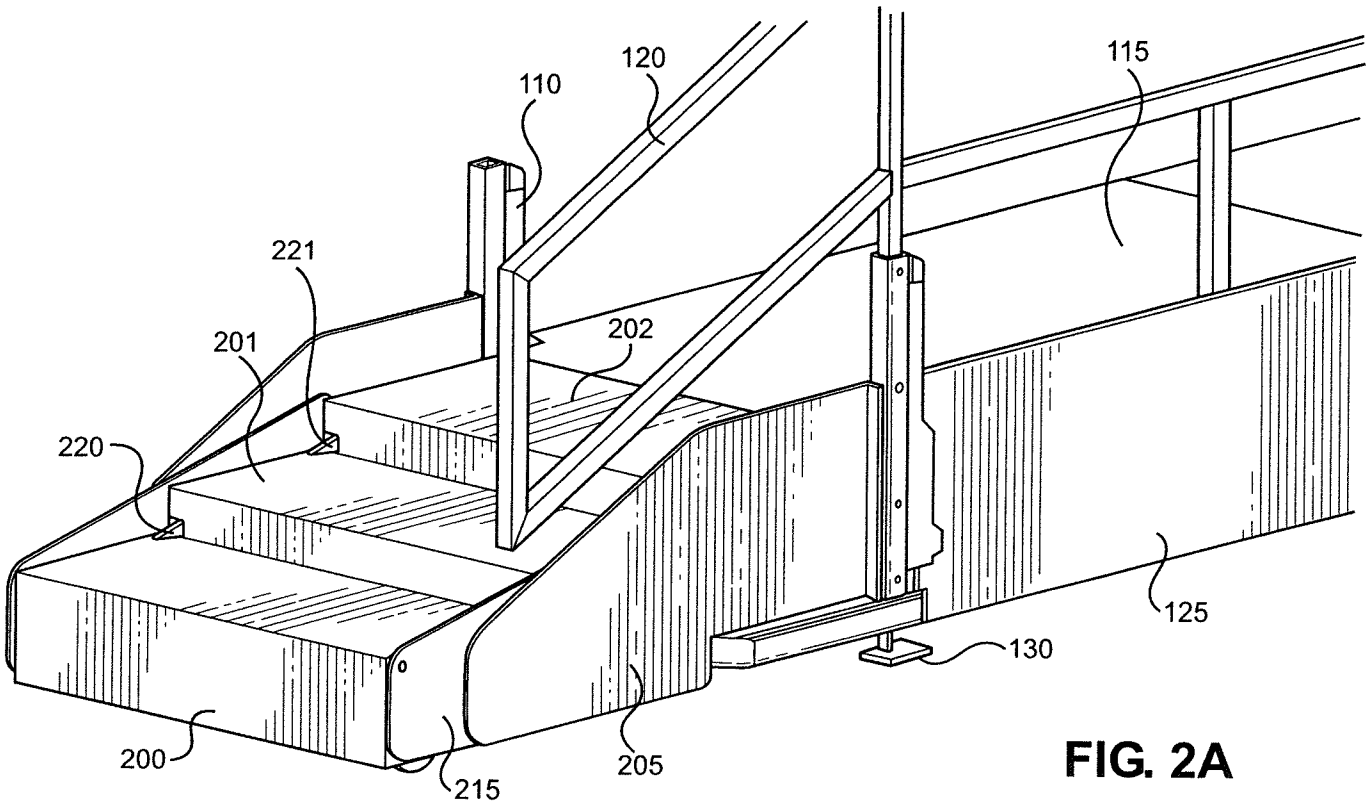
FIG. 2A is a perspective view of an adjustable staircase of the platform, with the platform at the first height.
Figure 2B:
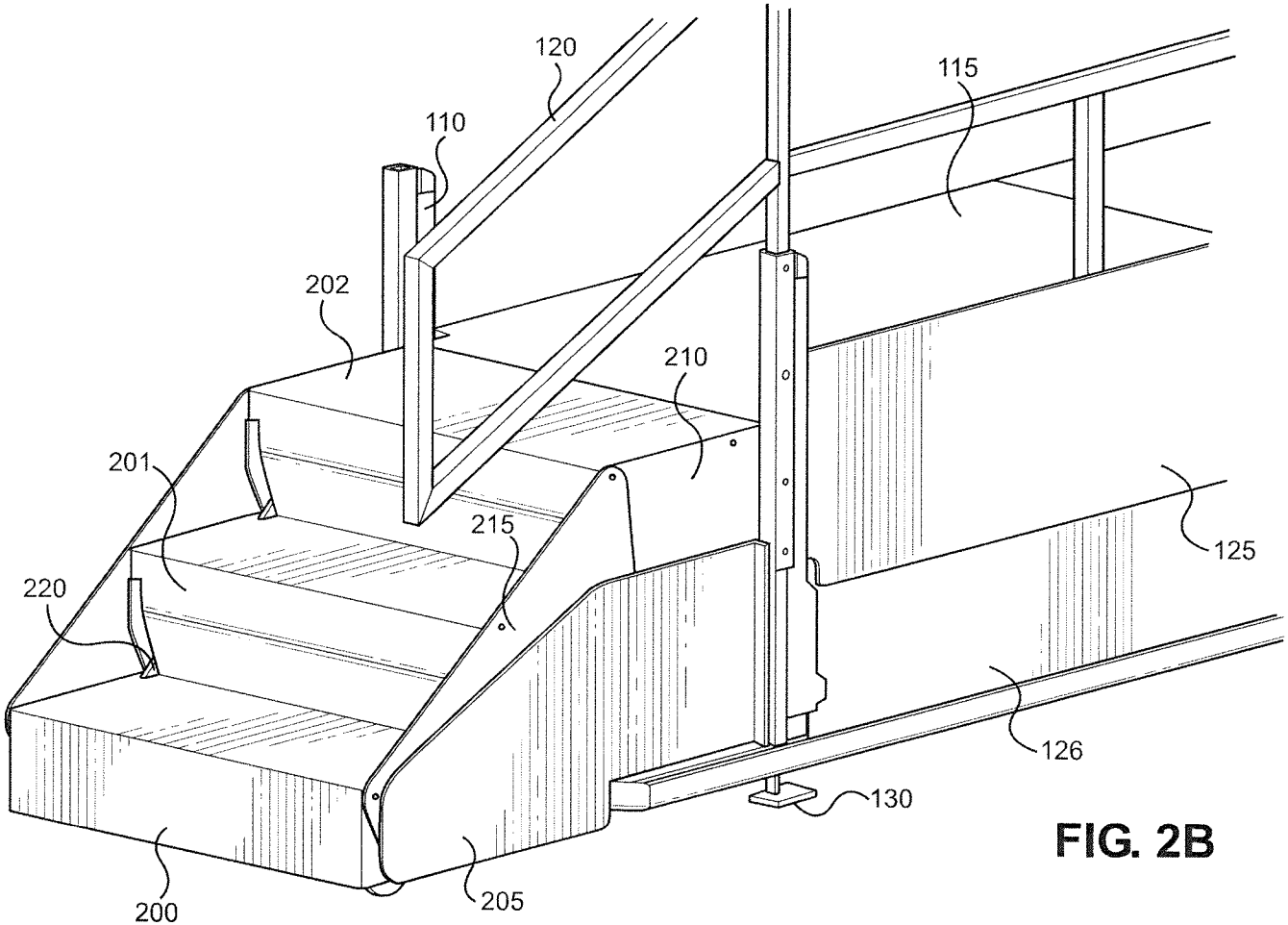
FIG. 2B is a perspective view of the staircase, with the platform at the second height.

With reference now to FIGS. 2A and 2B, staircase 105 will be described in further detail. A staircase constructed in accordance with the present invention includes at least two steps, although the upper of the two steps can be level with the upper platform or surface to which the staircase is coupled. In the embodiment shown, staircase 105 includes three steps: a lower step 200, an intermediate step 201 and an upper step 202. While upper step 202 is not shown as being integral with support surface 115, such an area is to be considered an upper step within the meaning of the present disclosure. Staircase 105 also includes a first pair of guards (with the right one labeled 205), a second pair of guards (with the right one labeled 210), a first pair of bars (with the right one labeled 215) and a second pair of bars (with the left one labeled 220). The first and second pairs of bars provide the adjustability of staircase 105, as will be described below in connection with FIGS. 3A-C. In addition, as can be seen in FIGS. 2A and 2B, the combination of guard 205, guard 210 and bar 215 eliminates all outside pinch points on the right side of staircase 105, while the corresponding structure on the left side of staircase 105 eliminates all outside pinch points on the left side of staircase 105. In other words, if the user were standing to the right of staircase 105, no pinch points would be visible on the right side of staircase 105 (and vice versa). However, it should be pointed out that other pinch points might still exist on the inside of staircase 105, with the inside defined as the area between guard 205, guard 210 and bar 215 on the right and the corresponding guards and bar on the left. For example, a portion of a user's body, or other object, inserted between bar 220 and intermediate step 201 or upper step 202 might be damaged at pinch points 221, 221' (best seen in FIG. 3A) when staircase 105 is adjusted from the position shown in FIG. 2B to the position shown in FIG. 2A.

As shown in FIG. 2B, guard 210 is formed integrally with step 202, although guard 210 can of course be formed separately. Each of steps 200-202 is preferably made from a two-piece construction. The first piece is a top, tread piece, while the second piece includes a front kick guard and two side panels (e.g., guard 210). In addition, clearance slots allow for angular adjustment of the second pair of bars.

Figure 2C:
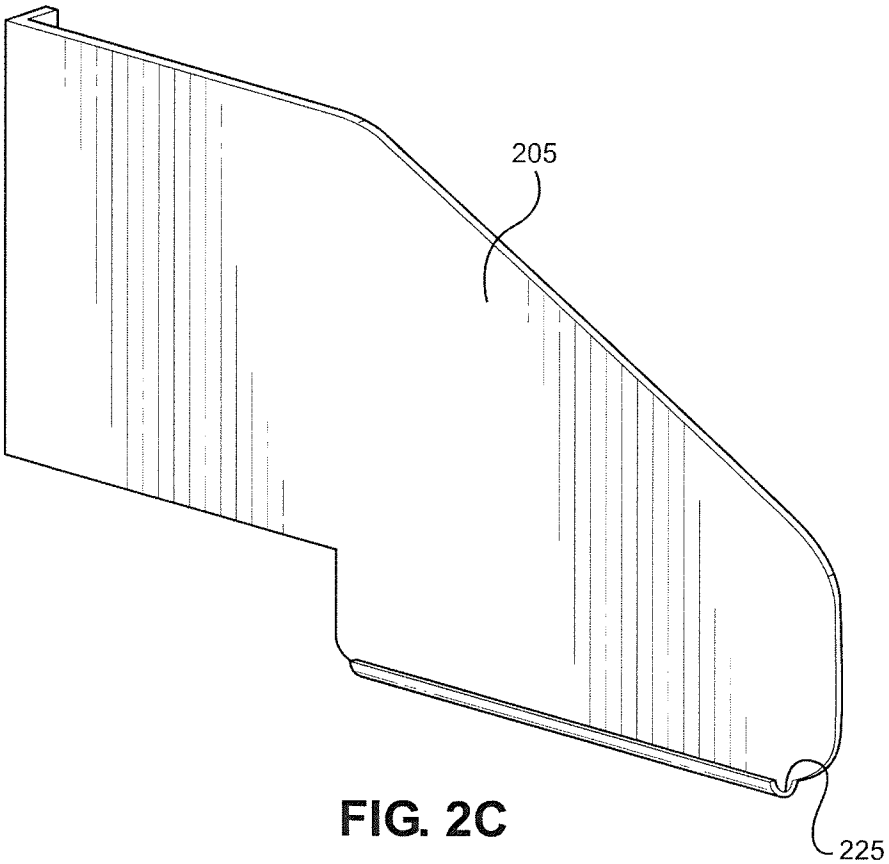
FIG. 2C is a perspective view of a guard of the staircase.

Turning to FIG. 2C, the inside of guard 205 is shown such that an in-turned, U-shaped groove 225 is now visible. Groove 225 supports a bottom edge of lower step 200, which helps keep bar 215 in place between lower step 200 and guard 205. In addition, groove 225 prevents staircase 105 from hanging below platform 100 if platform 100 is raised by a fork truck, for example. Although not shown, a corresponding groove is provided on the left guard of the first pair of guards.

Figure 3A:
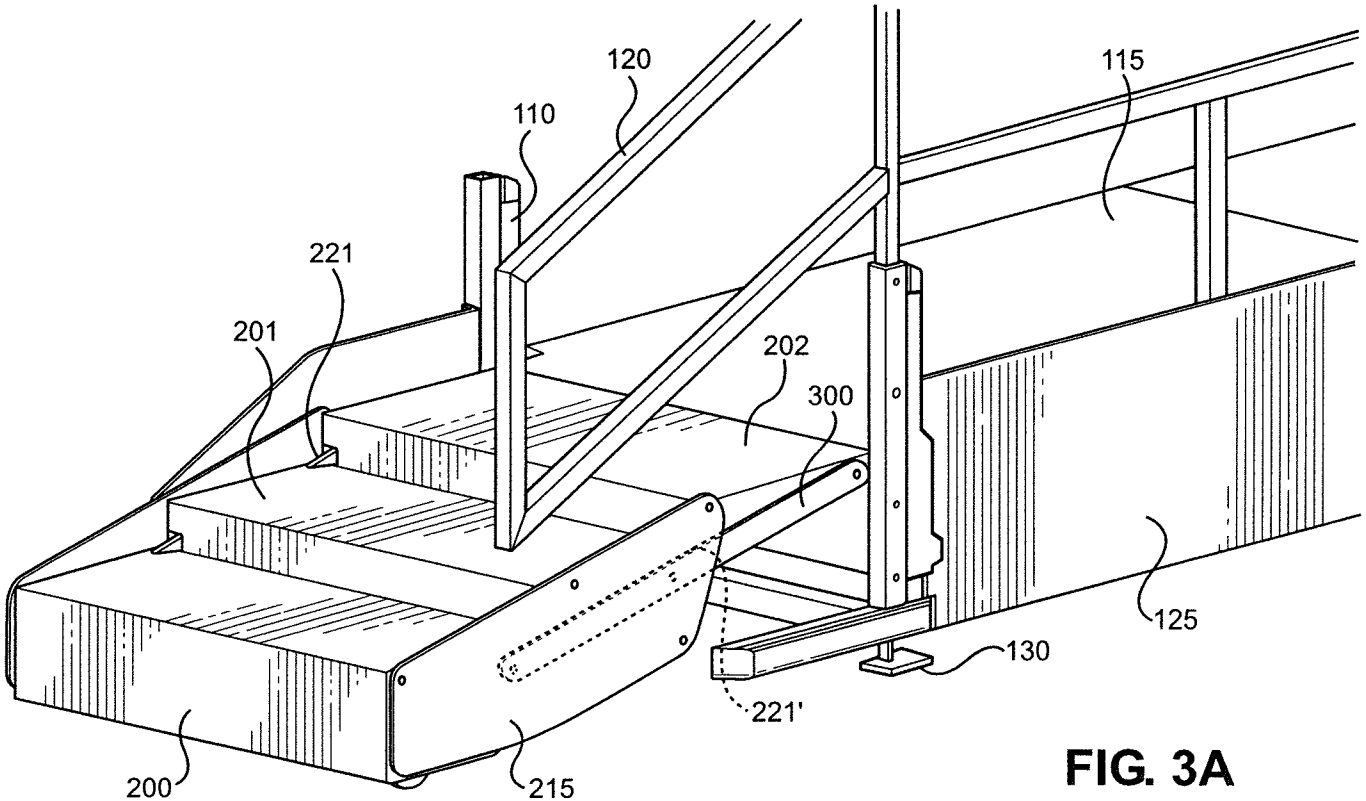
FIG. 3A is a perspective view of the staircase, as shown in FIG. 2A, with a portion of the staircase removed.
Figure 3B:
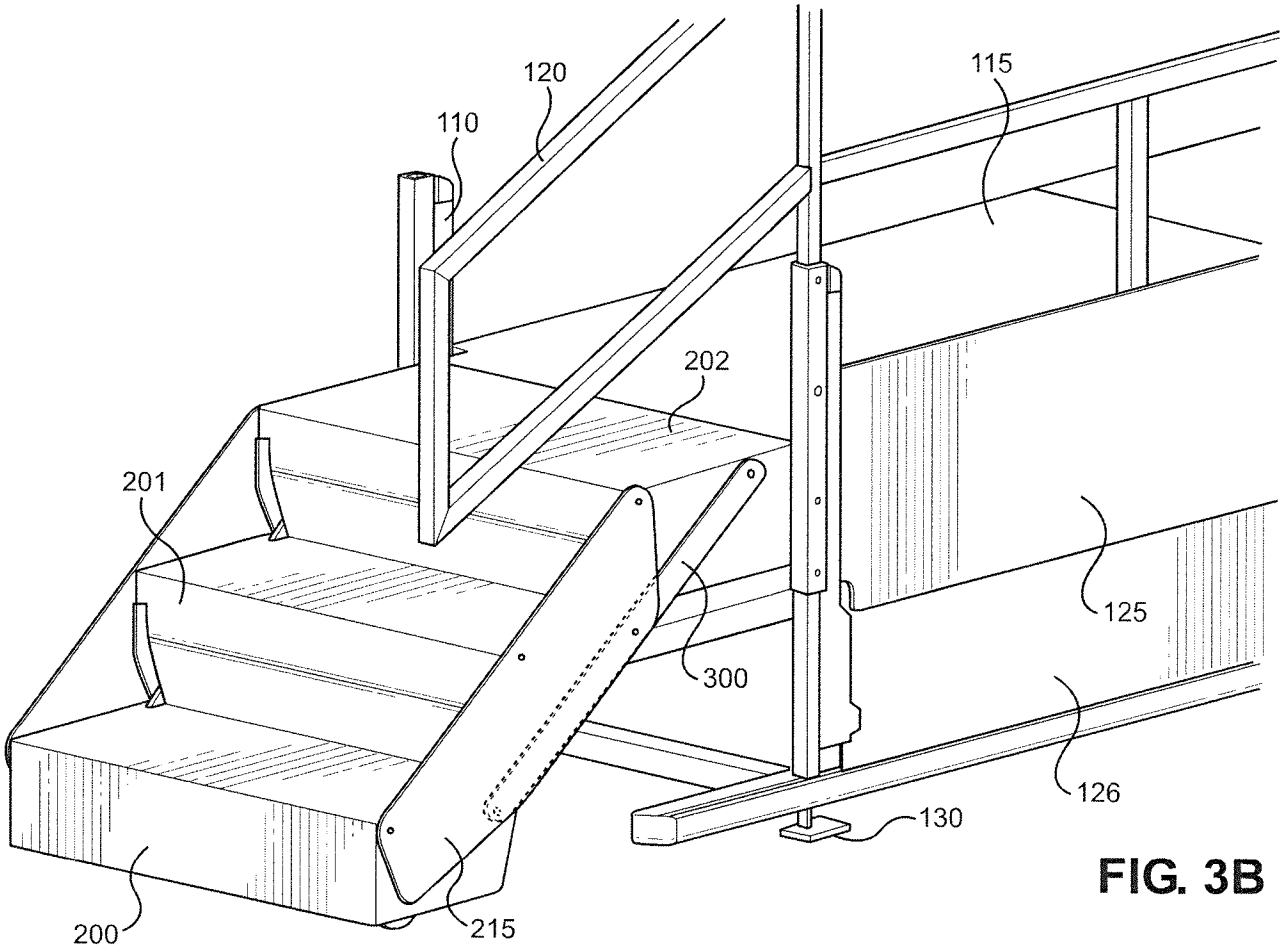
FIG. 3B is a perspective view of the staircase, as shown in FIG. 2B, with the portion of the staircase removed.

In order to better illustrate the adjustment of staircase 105, FIGS. 3A and 3B show staircase 105 with guards 205 and 210 removed. As a result, bar 215 and a bar 300 (which is one of the second pair of bars) are visible. Bars 215 and 300 are part of a four-bar linkage, with the remaining two bars defined by lower step 200 and upper step 202. Bar 215 is coupled to a front portion of each step 200-202, while bar 300 is coupled to a rear portion of each step 200-202. Therefore, as the height of upper step 202 is adjusted via the height-adjusting mechanisms, the angles of bars 215, 300 change relative to the surface on which platform 100 is supported, which results in an automatic adjustment of staircase 105. Although bar 215 is referred to as a bar, it should be noted that bar 215 also functions as a guard. In particular, bar 215 extends across bar 300 so as to cover the space between bar 215 and bar 300 (except for a small portion covered by guard 210), thereby eliminating a potential pinch point.

Figure 3C:
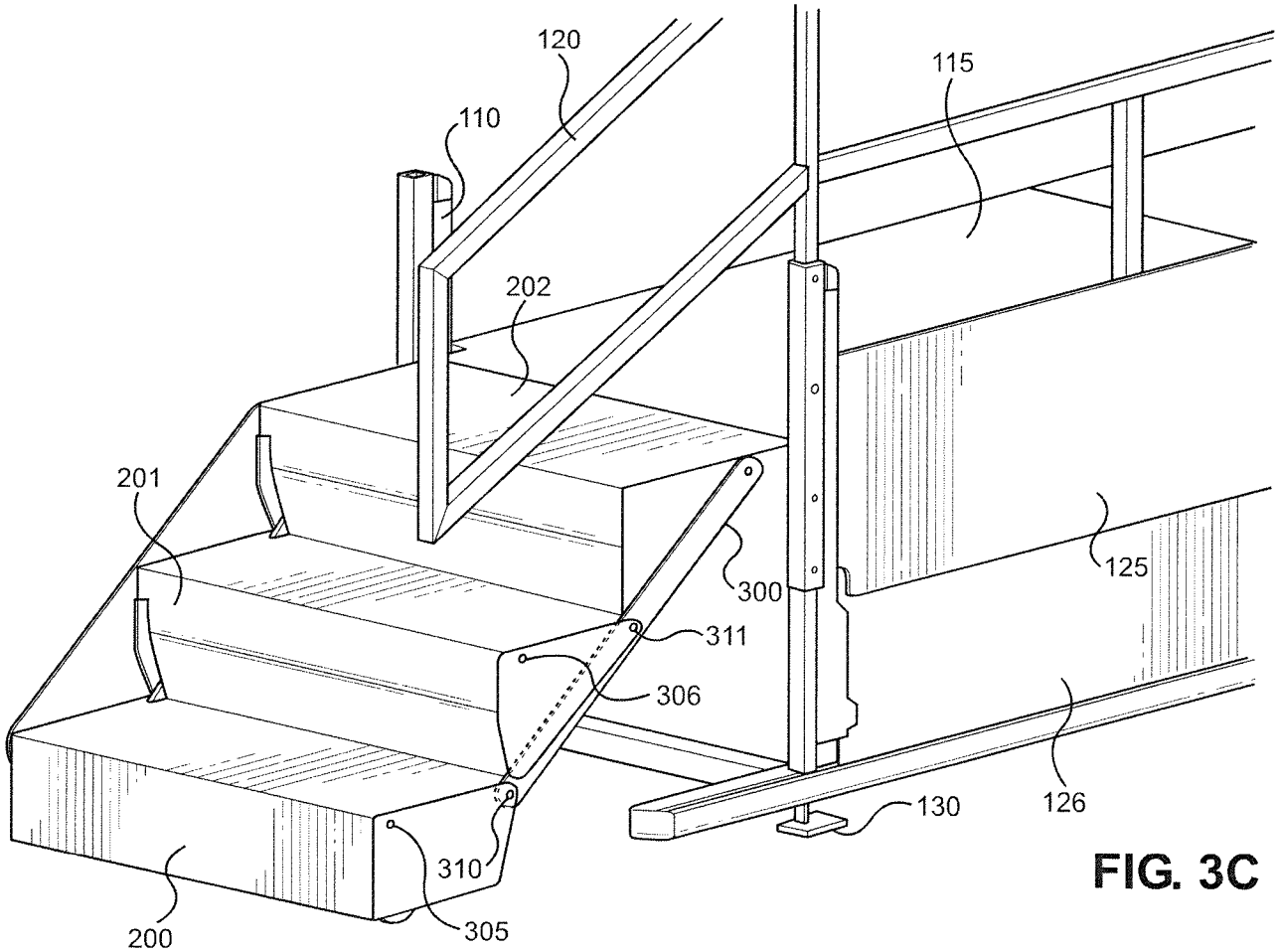
FIG. 3C is a perspective view of the staircase, as shown in FIG. 3B, with a further portion of the staircase removed.

In FIG. 3C, bar 215 is removed so that the right sides of steps 200 and 201 are more clearly visible. Front mounting points 305 and 306 are used to couple bar 215 to steps 200 and 201, while rear mounting points 310 and 311 are used to couple bar 300 to steps 200 and 201. Although not visible in FIG. 3C, guard 210 also includes front and rear mounting points for coupling bars 215 and 300 to step 202. Alternatively, when guard 210 is formed separately from step 202, step 202 can include the front and rear mounting points. The coupling of bars 215 and 300 to steps 200 and 201 is accomplished via a pin connection, although other coupling arrangements known in the art can of course be used.

Based on the above, it should be readily apparent that the present invention provides an adjustable staircase that eliminates the pinch points typically present on the sides of prior art staircases. Although described with reference to preferred embodiments, it should be readily understood that various changes or modifications could be made to the invention without departing from the spirit thereof. In general, the invention is only intended to be limited by the scope of the following claims.

The invention claimed is:

1. A height-adjustable platform comprising:

an adjustable staircase including:

an upper stair;

a lower stair;

a first bar coupled to a front portion of each of the upper and lower stairs and configured to function as a first guard; and a second bar coupled to a rear portion of each of the upper and lower stairs, wherein a vertical distance between the upper stair and the lower stair is adjustable, no pinch point is formed between the first bar and the second bar, the first bar extends across at least a portion of the second bar, and the second bar is located to the inside of the first bar.

2. The height-adjustable platform of claim 1, wherein the second bar is located on the right side of the staircase, and wherein, when viewed from the right side of the staircase, the second bar is not visible.

3. The height-adjustable platform of claim 2, wherein the first bar is located on the right side of the staircase and blocks a pinch point between the first bar and the upper or lower stair.

4. The height-adjustable platform of claim 3, wherein the staircase further includes:

a second guard; and a third guard coupled to or formed integrally with the upper stair.

5. The height-adjustable platform of claim 4, wherein the third guard is located on the right side of the staircase, and wherein, when viewed from the right side of the staircase, the third guard extends across at least a portion of the second bar.

6. The height-adjustable platform of claim 1, wherein the staircase further includes second and third guards, and wherein the second guard is located to the outside of the first bar, the first bar is located to the outside of the third guard and the third guard is located to the outside of the second bar.

7. The height-adjustable platform of claim 1, wherein the staircase further includes a height-adjusting mechanism configured to adjust the vertical distance between the upper stair and the lower stair.

8. An adjustable staircase comprising:

an upper stair;

a lower stair;

a first bar coupled to a front portion of each of the upper and lower stairs and configured to function as a first guard; and a second bar coupled to a rear portion of each of the upper and lower stairs, wherein a vertical distance between the upper stair and the lower stair is adjustable, no pinch point is formed between the first bar and the second bar, the first bar extends across at least a portion of the second bar, and the second bar is located to the inside of the first bar.

9. The adjustable staircase of claim 8, further comprising a second guard and a third guard, wherein the second guard is located to the outside of the first bar, the first bar is located to the outside of the third guard and the third guard is located to the outside of the second bar.

10. The adjustable staircase of claim 8, further comprising a height-adjusting mechanism configured to adjust the vertical distance between the upper stair and the lower stair.

11. An adjustable staircase comprising:

an upper stair;

a lower stair;

a first bar coupled to a front portion of each of the upper and lower stairs and configured to function as a first guard; and a second bar coupled to a rear portion of each of the upper and lower stairs, wherein a vertical distance between the upper stair and the lower stair is adjustable, no pinch point is formed between the first bar and the second bar, the first bar extends across at least a portion of the second bar, and the second bar is located to the inside of the first bar, wherein the second bar is located on the right side of the staircase, and wherein, when viewed from the right side of the staircase, the second bar is not visible.

12. The adjustable staircase of claim 11, wherein the first bar is located on the right side of the staircase.

13. The adjustable staircase of claim 12, further comprising:

a second guard; and a third guard coupled to or formed integrally with the upper stair.

14. The adjustable staircase of claim 13, wherein the third guard is located on the right side of the staircase, and wherein, when viewed from the right side of the staircase, the third guard extends across at least a portion of the second bar such that the pinch point is eliminated.

* * * * *